United States Patent [19]

Wilson

[11] Patent Number: 4,674,634

[45] Date of Patent: Jun. 23, 1987

[54] PACKAGE OF RECLOSABLE PLASTIC BAGS

[75] Inventor: Shari J. Wilson, Bloomington, Minn.

[73] Assignee: Minnesota Mining and Manufacturing Company, St. Paul, Minn.

[21] Appl. No.: 747,335

[22] Filed: Jun. 21, 1985

[51] Int. Cl.[4] ..... B65D 85/67; B65H 3/46

[52] U.S. Cl. ..... 206/554; 206/494; 206/820; 221/45; 229/175; 383/37

[58] Field of Search ..... 206/233, 390, 494, 554, 206/820; 221/33, 45, 63, 210, 289, 307; 229/175; 383/37

[56] References Cited

U.S. PATENT DOCUMENTS

| | | | |
|---|---|---|---|
| 2,671,602 | 3/1954 | Vogt | 383/37 |
| 2,715,493 | 8/1955 | Vogt | 206/554 |
| 3,770,188 | 11/1973 | Norman | 206/820 |
| 3,915,302 | 10/1975 | Farrelly | 206/554 |
| 4,349,123 | 9/1982 | Yang | 206/554 |
| 4,453,649 | 6/1984 | Origuchi | 206/554 |
| 4,500,021 | 2/1985 | Bildusas | 225/49 |
| 4,502,599 | 3/1985 | Perecman | 206/554 |

*Primary Examiner*—Joseph Man-Fu Moy
*Assistant Examiner*—Jimmy G. Foster
*Attorney, Agent, or Firm*—Donald M. Sell; James A. Smith; John C. Barnes

[57] ABSTRACT

A stack of plastic bags having a reclosable adhesive seal wherein the bags each have a flap and the bags are stacked end to end with the flaps at alternate opposite edges of the stack and each bag is adhered to the adjacent bag by the adhesive for sealing the flap to close the bag.

9 Claims, 5 Drawing Figures

PACKAGE OF RECLOSABLE PLASTIC BAGS

BACKGROUND OF THE INVENTION

1. Field of the Invention

This invention relates to an improved package of sealable polymeric bags, and in one aspect, to a stack of self-sealing polymeric bags joined in a stack to be readily dispensed.

2. Description of the Prior Art

Polymeric bags such as are illustrated in FIGS. 1, 2 and 3 of the accompanying drawing are well known, and utilize a flap which may be folded over the open side of the bag much as the flap of an envelope to close the same. The flap is provided with a strip of exposed pressure-sensitive adhesive material which will adhere to the body of the bag. In FIG. 1 there is illustrated a polymeric bag of generally rectangular shape with an extended flap to which is adhered a length of pressure-sensitive tape, and the opposite edge of the length of pressure-sensitive adhesive tape is covered by a strip of translucent or opaque plastic or paper material to form a tab for lifting the adhesive strip to open the seal strip from the body of the bag. The prior art as depicted in FIG. 2 is a polymeric bag of generally rectangular shape having an extended flap across which a length of double-coated adhesive tape is placed. The length of adhesive tape is narrower than the flap such that an adhesive free position of the flap is provided to permit reopening the bag more readily. The double-coated tape provides the sealing structure to seal the flap in a closed position. In FIG. 3 the bag is formed with a coating of adhesive applied below the opening of the envelope to permit the flap to be folded over the opening and adhered against the rear panel of the bag by the strip of adhesive.

There is no teaching of storing bags of this nature in a box such that they may be dispensed singly from the box for use as household bags or parts bags.

Other types of bags known in the prior art which come in a roll have the individual bags joined to the top and/or bottom of the next successive bag along a perforated heat-seal line. Preformed bags such as those commonly used with wire ties, fold or tuck flaps or zip-type fasteners are stacked in a box or folded and placed in a box. Dispensing one bag does not aid the dispensing of the next bag.

In a patent assigned to the assignee of this application, U.S. Pat. No. 4,502,599, there is shown a package of bags wherein the bags are held together by the alignment of the bags with the adhesive coated areas of the flaps contacting the surface of the flap of the adjacent bag opposite its adhesive coated area. This package is designed for supplying bags in a manner to speed the packaging of parts or articles by drawing the bag open, putting in the product, dispensing the bag from the stack and then sealing the flap.

The package of the prior patent permitted the use of aggressive adhesives as the adhesive of one tape strip was applied to the surface of the backing of the next tape which surface is coated with a low adhesion coating to permit the winding and unwinding of such tapes and similarly the separation of the tapes in that construction.

It is therefore an object of the present invention to provide a package including a stack of closable and resealable plastic bags such that they may be dispensed individually and are stored in the box for use on demand. The tape adhesive and the film material forming the bags are compatible to permit separation without deleteriously affecting the bags.

SUMMARY OF THE INVENTION

The present invention relates to an improved method of packaging adhesive sealable and resealable polymeric bags which are formed with an envelope having a front panel and a rear panel joined by a fold or heat seal or solvent sealing to join three edges of the panels. An extended flap on the front panel extends above the fourth edge of the back panel and may be folded over the open side. A strip of adhesive is exposed when the bag is opened for sealing the flap to the rear panel of the bag. The strip of adhesive may be defined by a strip of pressure-sensitive adhesive tape adhered along one edge of the free edge of the flap and the tape extends beyond the flap to expose a portion of the adhesive coated on the tape surface for use in sealing the flap over the opening and to the rear panel of the bag. A plurality of the bags with the adhesive on the flap are stacked end for end with the adhesive side of the flap joined to the front panel of the next bag along the edge opposite the flap such that the adhesive coated flaps are positioned along alternately opposite edges of the bags in the stack such that the closed end of one bag may extend through an opening in the upper surface of the box, and by grabbing the bottom edge of a bag and withdrawing the same through an opening in the top of the box, the adhesive will pull the bottom edge of the next successive bag through the opening and the bags may then be separated by peeling the adhesive coated edge of the bag dispensed from the front panel of the next successive bag which has then been drawn through the opening.

The box has a depth less than one-half the length of the front panel and the flap and the box has an opening in the top thereof extending parallel to the bottom edge of the bags. The opening in the box may be outlined with a thin plastic film having a resilience which will last through the life of the package.

The stack of bags formed in this manner protect the adhesive from contamination until the bag has been used. The adhesive of the bag extending from the box is also protected as it is adhered to the next bag in the box.

The box supporting the stack of bags has sufficient length and breadth to contain a stack of bags oriented as above-described with each bag in the box lying generally parallel to the top of the box. The box may rest on the bottom or on a side and the bags may be withdrawn through the opening.

DESCRIPTION OF THE DRAWINGS

The present invention will be further described with reference to the accompanying drawing wherein.

DESCRIPTION OF THE PREFERRED EMBODIMENTS

Figure 1:
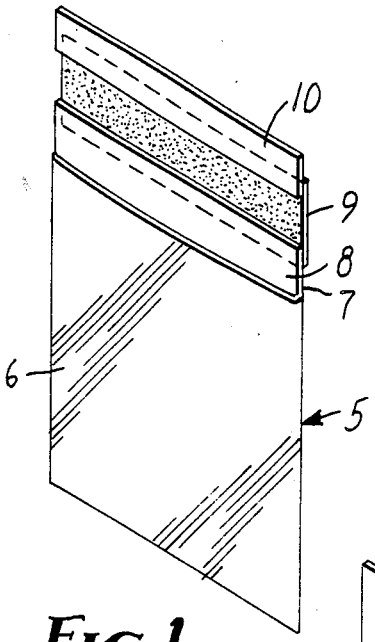
FIG. 1 PRIOR ART
FIG. 1 is a perspective view of a bag suitable for packaging according to the present invention.

A bag 5 usable in the present invention comprises an envelope having a rear panel 6 joined by a fold, heat sealing or bonding in some fashion along its bottom and side edges to a front panel 7 which has a flap 8 extending therefrom above the rear panel 6 defining thereby an envelope for receiving an article. The bag 5 can be sealed by a strip of pressure-sensitive adhesive 9 provided along the length of the free edge of the flap 8. One edge of the length of adhesive tape 9 is adhered to the front side of the flap 8 and the remaining adhesive coated portion of the tape 9 is exposed to seal the flap over the opening in the envelope to the rear panel 6. A tab strip 10 of translucent or opaque plastic, paper stock or other suitable material may be adhered along the opposite edge of the strip of tape 9 to provide a tab affording an edge which may be grasped for easy opening of the bag after it has been sealed. Alternatively, the edge of the tape 9 may be folded upon itself to form the tab.

Figure 2:
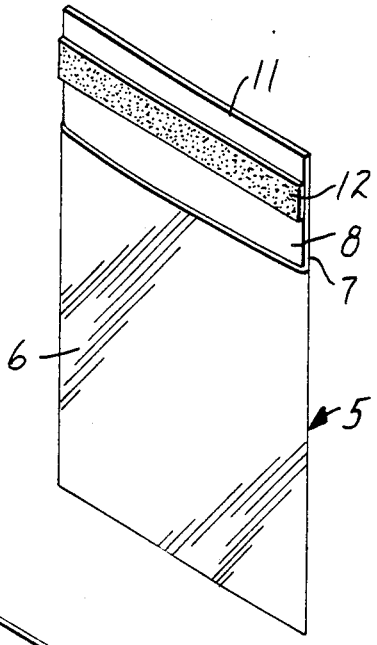
FIG. 2 PRIOR ART
FIG. 2 is a perspective view of a second embodiment of a reclosable or resealable bag for use in practicing the present invention.

In FIG. 2 a bag 5 of similar construction having a rear panel 6 and a front panel 7 adhered thereto along the bottom and opposite parallel side edges has a flap 8 extending above the rear panel 6. In this embodiment the flap 8 has a strip of double-coated adhesive tape 12 adhered to the front face of the flap 8. The strip of adhesive tape is positioned along the flap 8 in spaced relation to the extended free edge 11 thereof to define a flap or tab for facilitating the reopening of the bag. In this embodiment the flap 8 may be closed over the open side of the envelope and the exposed adhesive coated face of the double-coated tape 12 will be exposed to seal the flap against the rear panel 6 of the envelope.

Figure 3:
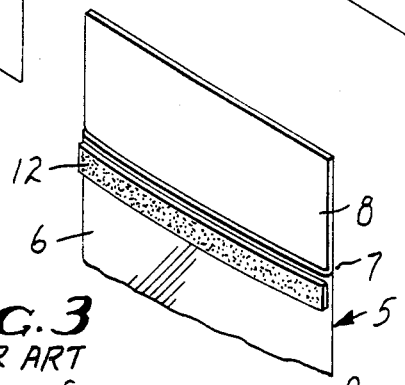
FIG. 3 PRIOR ART
FIG. 3 is a fragmentary perspective view of a further embodiment of a bag for use in practicing the present invention.

In FIG. 3 a bag 5 of similar construction having a rear panel 6 and a front panel 7 adhered thereto along the bottom and opposite parallel side edges has a flap 8 extending above the rear panel 6. In this embodiment the flap 8 has no tape adhered to it. A strip of double-coated adhesive tape 12 is adhered to the surface of the rear panel 6 adjacent or spaced from the bag opening. The strip of adhesive tape 12 is positioned to engage the rear face of the flap 8 to seal the flap over the bag opening to the rear panel of the bag. In this embodiment the flap 8 may be closed over the open side of the envelope and the exposed adhesive coated face of the double-coated tape 12 will seal the flap against the rear panel 6 of the envelope and a portion of the flap 8 will extend past the strip of adhesive to aid in later opening the bag.

Figure 4:
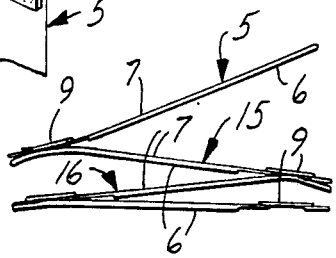
FIG. 4 illustrates a stack of bags stacked according to the present invention.
Figure 5:
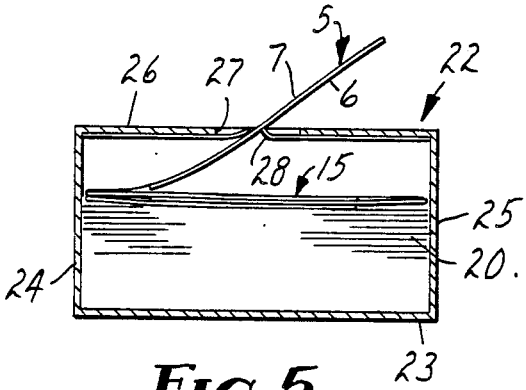
FIG. 5 is a vertically sectional view through a box containing a stack of bags as illustrated in FIG. 1 and stacked as illustrated in FIG. 4, with the end of one of the bags extending through the opening to be dispensed therethrough and simultaneously drawing the next successive bag through the opening.

Referring now to FIG. 4 there is illustrated a stack of sealable and/or resealable or reclosable plastic bags wherein the bags are stacked one on top of the other in a stack, end to end, such that the adhesive coated areas on flaps are positioned along alternate opposite edges in the stack. In the stack, the top bag in the stack has the adhesive area positioned downward to contact the next bag. The bottom sealed end of the top bag may then be positioned through a dispensing opening in the top of a box, as illustrated in FIG. 5. The upper end and flap of the first bag 5 is positioned such that the adhesive coated surface of the tape closure 9 is positioned to engage the front panel 7 of the next successive bag 15. The adhesive coated flap of the bag 15 has its adhesive coated surface of the flap engaging the front panel adjacent the closed bottom edge of the next bag 16. The bags are thus placed in the stack with the flaps positioned at alternate opposite edges of the stack such that the removal of one bag from the stack will serve to separate the bottom of the next bag from the stack and then the top bag may be separated from the next successive bag by peeling the adhesive free from the next bag.

A stack 20 of bags as described and illustrated in FIG. 3 may be placed in a rectangular box 22 as illustrated in FIG. 5. The box 22 preferably comprises a bottom wall 23, opposite side walls 24 and 25, end walls (only one of which is shown), and a top wall 26. The top wall 26 is provided with a dispensing opening 27 across which may be a thin flexible resilient membrane 28 formed of polymeric film having an opening therethrough permitting the bags to be drawn through the opening 27 but affording sufficient resistance to grasp the next successive bag in the stack to hold the same in the opening of the box 22. The box could be set on a side wall 24 or 25 and the bags could be dispensed, particularly where the box is shallow and the number of bags in the stack is limited. Otherwise a spring means should be placed in the box on the side of the stack opposite the opening to urge the stack toward the opening.

As shown in FIG. 5, by grasping the extended end of the top bag in the stack, the bag may be withdrawn through the slit in the membrane 28 and out through the opening 27 of the box. The bag is then peeled free from the next successive bag for use to seal a sandwich, a part, garbage, or other items for which bags are used around the house. The box 22 provides a container for the stack of plastic bags and the adhesive coated flap of the next successive bag is preferably still in the box and protected from ambient dust particles in the air.

It is to be understood that the bags could be placed in such a position that the flap extends through the opening of the box 22, and upon withdrawing the top end of the bag, by grasping the flap 8, the flap of the next successive bag could be drawn through the opening and then the bags peeled apart. It is preferable in accordance with the teaching of the present invention however, to have the bottom edge of the bag extending out through the opening in the box 22 such that the adhesive, which is to be used for sealing the bag will not be exposed.

Examples of materials useful to make the bags include polyester, low density polyethylene, which is 0.5 mil to 5 mils; (0.012 mm to 0.127 mm) thick, preferably 2 mils (0.5 mm), high density polyethylene 0.25 mils (0.06 mm) thick, biaxially oriented polypropylene, ethylene vinyl acetate coated low density polyethylene, nylon, laminates of these films, paper of 1 to 10 mils (0.025 to 0.05 mm), metallized films and foil laminates.

A preferred tape for resealing the bags after they have been sealed is "Scotch" Brand Tape No. 800, a pressure-sensitive tape available from Minnesota Mining and Manufacturing Company of St. Paul, Minn. A tape suitable for use as tape 12 is "Scotch" Brand Double-Coated Tape No. 665 or "Scotch" Brand Transfer Tape No. 969, also available from Minnesota Mining and Manufacturing Company of St. Paul, Minn.

A specific example of a bag is as follows:

A bag made from 1.5 mil low density polyethylene using "Scotch" brand 800 tape located on the extended flap of a bag of the J-fold type. In a test according to ASTM-D-3330 the peel adhesion value for the tape was 28.0 oz/in. In a test according to ASTM-D-3330 with the exception of 1.5 mil low-density polyethylene film as the substrate for the tape rather than steel to measure peel adhesion, the value was 5.0 oz/in. In a test according to ASTM-D-3654 with the exception that the tape sample area was $\frac{3}{4}$ in.$\times\frac{1}{2}$ in. and the substrate was 1.5 mil low-density polyethylene film instead of fiberboard the value was 102.4 min.

Examples of the other specific films for forming the bag and the peel adhesion value of the "Scotch" brand 800 tape to the films are as follows:

| Film | Peel Adhesion (oz/in) |
|---|---|
| polyester | $x \leqq 28$ |
| biaxially-oriented polypropylene | $1.5 \leqq x \leqq 32$ |
| low-density polyethylene | $x \leqq 8.0$ |
| "Elvax" No. 260, trademark of E. I. duPont de NeMours, Wilmington, Delaware | $1.0 \leqq x \leqq 25.0$ |
| ethylene vinyl acetate coated low-density polyethylene | $x \leqq 8.0$ |
| Nylon from E. I. duPont de Nemours, Wilmington, DE | $x \leqq 24.0$ |
| "Saran", trademark of Dow Chemical, Midland, MI | $x \leqq 7.0$ |
| coextruded polypropylene/ethylene vinyl acetate | $4.0 \leqq x \leqq 12.0$ |

The adhesive on the tape used for closing the bag may also be a tack-free adhesive of the type disclosed and claimed in U.S. patent application Ser. No. 703,299, of Robert C. Brown and Shih-Lai Lu, assigned to the assignee of this application. This adhesive is tack-free to the touch and thus differs from the adhesives such as on tape No. 665, 969 or 800, referred to above, and has specific adhesion properties for certain substrates.

This manner of packaging the sealable and reclosable plastic bags provides easy access to the bags and avoids contamination of the adhesive on the bag which is used for sealing the flap over the open edge of the bag. Further, if the part or article placed in the envelope of the bag does not extend to the open edge, the fold in the bag may be placed below the open edge and the adhesive sealed against the rear panel of the bag at any position.

The present invention has been described with reference to a preferred embodiment, and it is to be appreciated that changes may be made without departing from the spirit or scope of the invention as defined by the appended claims.

I claim:

1. A stack of adhesive sealable plastic bags comprising a plurality of bags each comprising a rear panel and front panel joined along three edges to form an envelope and a flap connected to the front panel and extending from the front panel to fold over a fourth open edge of the envelope, and a strip of resealable adhesive positioned on one of the rear side of said flap and the rear panel of said bag to seal the flap against the rear panel, said bags being positioned in a stack with opposite panels of adjacent bags in face to face relationship and with the flaps at alternate opposite edges of the stack with the strip of resealable adhesive on one bag engaging the front panel of the next adjacent bag to hold all bags in the stack joined by the strips of resealable adhesive used to seal the individual bags when separated from the stack.

2. A stack of plastic bags according to claim 1 wherein said strip of adhesive is on said flap.

3. A stack of plastic bags according to claim 1 wherein said strip of adhesive is on said rear panel adjacent and parallel to the open edge of the envelope.

4. A package of adhesive sealable plastic bags comprising a stack of bags each comprising a rear panel and front panel joined along three edges to form an envelope and a flap connected to the front panel and extending from the front panel to fold over a fourth open edge of the envelope, and a strip of resealable adhesive positioned on one of the rear side of the flap and the rear panel to be exposed on the rear of the bag to seal the flap against the rear panel, said bags being positioned in said stack with opposite panels of adjacent bags in face to face relationship and with the flaps at alternate opposite edges of the stack with the strip of resealable adhesive on one bag engaging the front panel of the next adjacent bag to hold all bags in the stack joined by the strips of resealable adhesive, and a box enclosing said stack of bags, said box comprising a top panel having an opening extending across said top panel and parallel to said strips of resealable adhesive through which said bags may be dispensed.

5. A package according to claim 4 wherein a polymeric membrane with a slotted opening is positioned at said opening in said top panel and reduces the size of the opening in said top panel and affords a restricted opening for dispensing said bags.

6. A package of plastic bags according to claim 4 wherein said strip of adhesive is on said flap.

7. A package of plastic bags according to claim 4 wherein said strip of adhesive is on said rear panel adjacent and parallel to the open edge of the envelope.

8. A package of plastic bags according to claim 6 wherein said strip of adhesive is provided by a length of double coated pressure sensitive adhesive tape applied to the flap.

9. A package of plastic bags according to claim 6 wherein said strip of adhesive is a length of adhesive tape having one edge adhered to the edge of said flap.

* * * * *